US005499684A

United States Patent [19]

Stratton

[11] Patent Number: 5,499,684

[45] Date of Patent: Mar. 19, 1996

[54] GEOGRAPHIC SURFACE ALTERING IMPLEMENT CONTROL SYSTEM

[75] Inventor: Kenneth L. Stratton, Dunlap, Ill.

[73] Assignee: Caterpillar Inc., Peoria, Ill.

[21] Appl. No.: 291,263

[22] Filed: Aug. 16, 1994

[51] Int. Cl.[6] ..... E02F 3/76; E02F 3/85

[52] U.S. Cl. ..... 172/4.5; 172/812; 91/520; 364/424.07

[58] Field of Search ..... 172/4, 4.5, 812, 172/824, 826; 37/382, 414; 364/424.07; 91/520

[56] References Cited

U.S. PATENT DOCUMENTS

| | | | |
|---|---|---|---|
| 4,157,118 | 6/1979 | Suganami et al. | 172/4.5 |
| 4,166,506 | 9/1979 | Tezuka et al. | 172/4.5 |
| 4,282,933 | 8/1981 | Suganami et al. | 172/4.5 |
| 4,516,469 | 5/1985 | Sato et al. | 91/362 |
| 4,630,685 | 12/1986 | Huck, Jr. et al. | 364/424.07 |
| 4,802,537 | 2/1989 | Ryerson | 172/812 |
| 4,934,463 | 6/1990 | Ishida et al. | 172/4.5 |

*Primary Examiner*—Eric K. Nicholson
*Assistant Examiner*—Spencer Warwick
*Attorney, Agent, or Firm*—Alan J. Hickman

[57] ABSTRACT

A tilt angle control system has first and second sensors for sensing the position of the rod end portion of first and second lift jacks. A controller calculates an actual tilt angle of an implement connected to the rod end portions of the lift jacks based on a difference in the amount of extension relative to a baseline. A display device displays the actual and desired tilt angles. The controller compares the actual tilt angle to a desired tilt angle and actuates a fluid operated system to move one of the first and second jacks in response to a difference between the desired and actual tilt angles. An inclinometer sensed angle of the machine relative to a horizontal plane is added to the actual tilt angle to correct the actual tilt angle of the implement. The tilt angle control system is particularly suited for use on a bulldozer.

27 Claims, 4 Drawing Sheets

GEOGRAPHIC SURFACE ALTERING IMPLEMENT CONTROL SYSTEM

TECHNICAL FIELD

This invention relates to a control system for an implement and more particularly to a control system for monitoring and controlling the position of a geographic surface altering implement.

BACKGROUND ART

Systems for controlling the position of a geographic surface altering implement have been utilized for decades. For example, such control systems are used to move implements used on machinery such as bulldozers, motor graders, wheel loaders, compactors, pavers, asphalt layers, profilers, and the like. Typically, the control system enables a vehicle operator, depending upon the specific type of implement being controlled, to control lifting, tilting, and tipping of the implement by way of a fluid operated system. Because such systems are manually controlled (requires good hand-eye coordination) the accuracy and consistency of implement positioning will vary from operator to operator and from time to time. Since a substantial amount of trial and error is required by even the most skilled operator both efficiency and accuracy of operation will suffer.

To tilt an implement, for example the blade of a bulldozer, to an angle required to obtain the desired slope of cut is difficult for even the most skilled operator. This is based on the fact that the tilted angle of the blade is an operator observed position and not based on a fixed reference. It is particularly difficult to position and maintain the blade at a desired resultant angle under the dynamics of vehicle operation since any visual reference made to the terrain varies as the machine travels along the underlying surface. Thus, numerous additional passes of the dozing vehicle and frequent checks (surveys) of the worked surface are required.

Attempts have been made to automate positioning of geographic surface altering implements. An example of such an attempt is shown in U.S. Pat. No. 4,282,933, dated Aug. 11, 1981, to Takashi Suganami. This patent discloses, among other things, an automatic tilt control utilizing an inclinometer mounted on the dozer blade for sensing the tilt angle of the blade relative to the horizontal and a tilt angle setting device for selecting the desired tilt angle. The output from the inclinometer and the tilt angle setting device are compared and a corresponding signal is delivered to the tilt control system. This causes energization of a solenoid operated valve and tilting of the blade to the desired resultant angle. Tilting of the blade continues during operation to maintain the blade at the desired angle. Inclinometers tend to be sensitive to motion and deliver erroneous signals when jostled about. Mounting of the inclinometer on a dozer blade, an implement that is constantly moved, vibrated, and subjected to the harshness of earthmoving is inappropriate.

Automatic systems for use in harsh geographic surface altering applications have not been proven satisfactory as operation accuracy and life are inadequate.

The present invention is directed to overcoming one or more of the problems as set forth above.

DISCLOSURE OF THE INVENTION

In one aspect of the present invention a tilt angle control system for a geographic surface altering implement is provided. First and second fluid operated lift jacks, each having first and second end portions, are connected at the first end portion to a frame and at the second end portion to the implement at a preselected spaced apart distance. The second end portion of the first and second lift jacks is movable relative to the first end portion of the first and second lift jacks, respectively, and the implement is movable relative to the frame in response to movement of the second end portion of at least one of the lift jacks. A first sensor senses the position of the second end portion of the first lift jack relative to the first end portion of the first lift jack and delivers a responsive first position signal. A second sensing means senses the position of the second end portion of the second lift jack relative to the first end portion of the second lift jack and delivers a responsive second position signal. A control means receives the first and second position signals, determines a magnitude of difference between the relative positions of the first end portion of the first and second lift jacks, calculates an implement tilt angle based on the relative difference, and delivers a responsive tilt angle signal.

In another aspect of the present invention, the tilt angle control system includes a third sensing means for sensing an angle of the frame relative to a horizontal plane and delivers a responsive frame angle signal. The control means receives the frame angle signal, the first position signal, and the second position signal, determines the magnitude of difference between the relative positions of the first end portion of the first and second lift jacks based on the first and second position signals, calculates the implement tilt angle based on the magnitude of difference and the preselected distance between at the implement connection, combines the frame angle and the tilt angle and delivers a responsive corrected tilt angle signal.

BEST MODE FOR CARRYING OUT THE INVENTION

Figure 1:
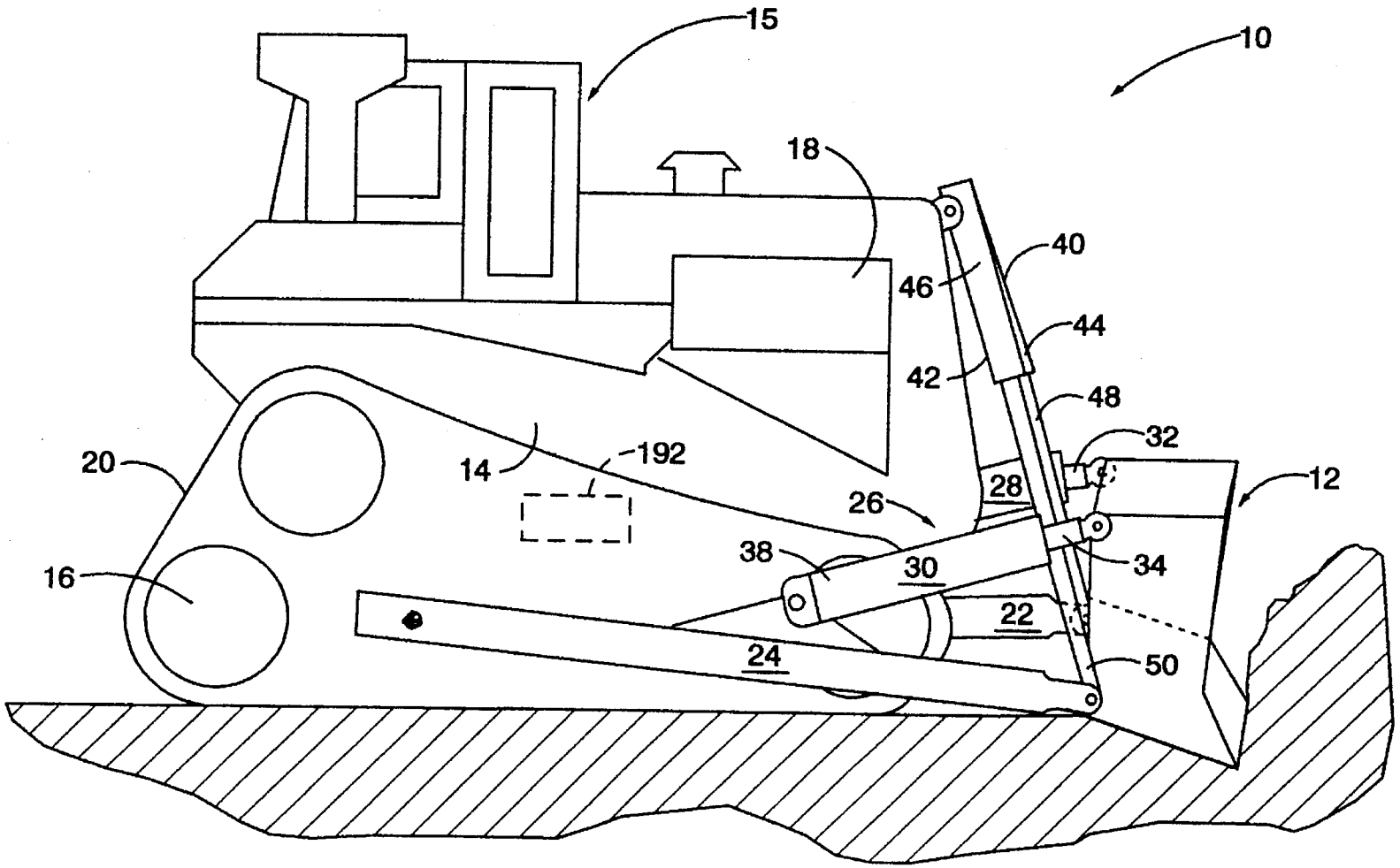
FIG. 1 is a diagrammatic side elevational view of an embodiment of the present invention showing geographic surface altering machine having an implement movably mounted thereon.

With reference to FIG. 1, a side elevational view of an embodiment of a geographic surface altering machine 10 having an implement 12 movably mounted thereon is disclosed. In the particular embodiment shown the geographic surface altering machine is a track type tractor and the implement is an elongate blade used for dozing. To simplify the explanation of the invention discussed herein will be limited to the specific embodiment shown, however, it is noted that other machinery having a movable geographic surface altering implement, for example, a motor grader, wheel loader, compactor, paver, asphalt layer, profiler, and the like are equivalents and within the scope of this invention.

The machine 10 has a frame 14, an undercarriage 16 connected to the frame 14, and a prime mover 18 such as an internal combustion engine. The prime mover 18 is drivingly connected to an endless track 20 of the undercarriage 16, in any conventional well known manner. The prime mover rotates the track 20 and propels the machine 10 over the underlying terrain.

First and second spaced apart push arms 22,24, pivotally connected at opposite ends thereof to the implement 12 and the frame 14, respectively, in a conventional manner, such as by a pivot shaft, pivotally connects the implement 12 to the frame 14. The push arms are substantially the same length and hold the implement transverse a front end of the machine 10 as viewed from the operators station 15.

Figure 4:
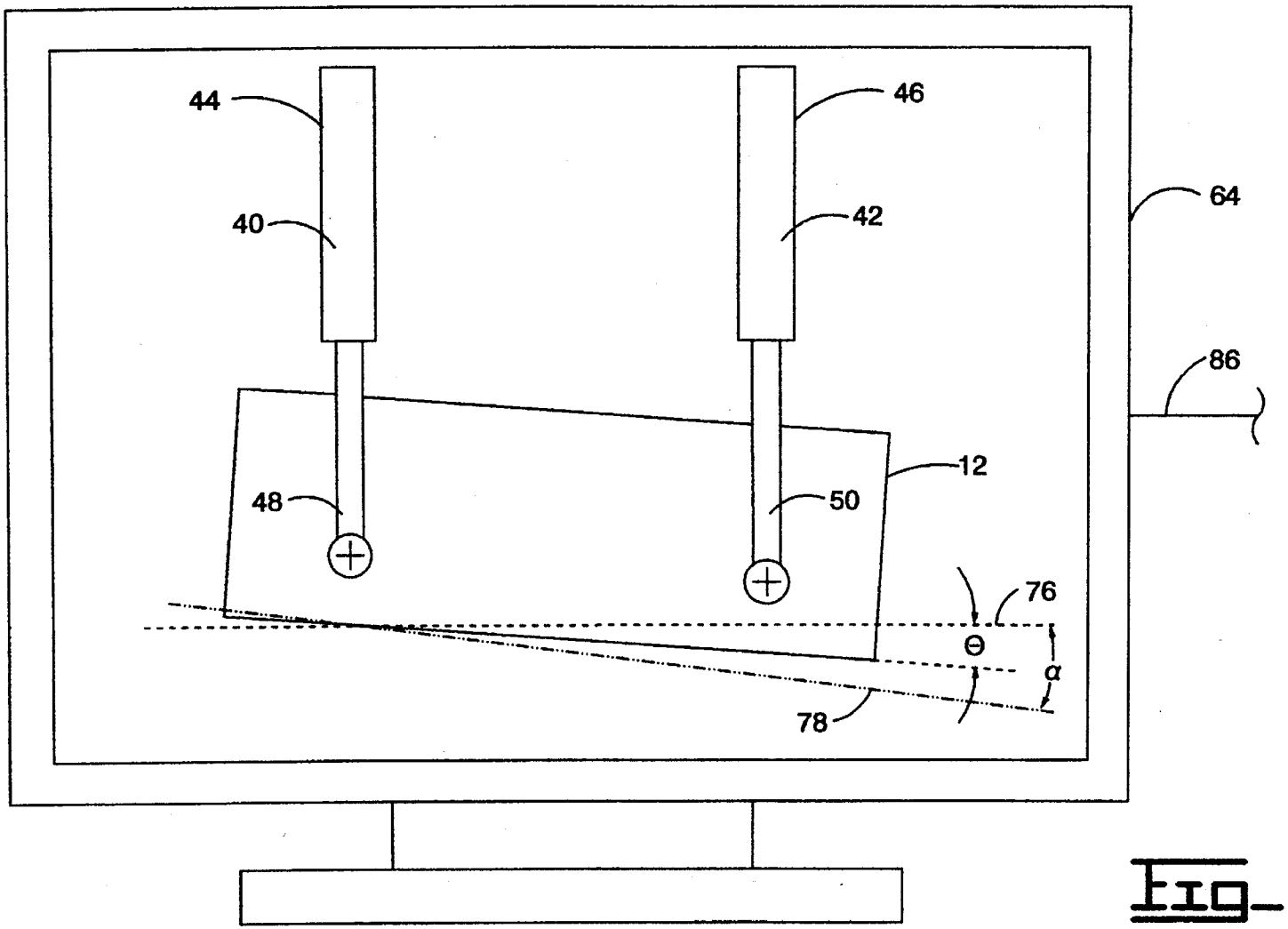
FIG. 4 is an enlarged diagrammatic front plan view of a monitor of FIG. 1 disclosing the angular position of the implement relative to a baseline and a desired position line.

A tilt jack means 26, including first and second spaced apart fluid operated extensible tilt jacks 28,30, preferably hydraulic cylinders but not limited thereto, is provided for tilting the implement 12 relative to the frame 14 in first and second directions from a base position. The base position is defined as a substantially horizontal position of the implement when the machine 10 is supported on a substantially flat horizontal surface. A rod end portion 32 of the first tilt jack 28 is pivotally connected to the implement 12, in a conventional manner, such as by a clevis and pivot pin. Similarly, a rod end portion 34 of the second tilt jack 30 is pivotally connected to the implement 12, in a conventional manner, such as by a clevis and pivot pin. A head end portion 36 of the first tilt jack 28 is pivotally connected to the first push arm 22 in a conventional manner, such as by a clevis and pivot pin. Similarly, a head end portion 38 of the second tilt jack 28 is pivotally connected to the second push arm 24 in a conventional manner, such as by a clevis and pivot pin. It is to be noted that the rod and head end connections can be reversed without departing from the spirit of the invention. Extension or retraction of the rod end portion 32,34 of either of the first and second tilt jacks 28,30 relative to the head end portion 36,38 will cause tilting of the implement 12. In this context, the slope of dozing is controlled by controlling the tilt angle θ (FIG. 4). The tilt angle θ as seen from the operators station 15 appears as a relative lowering of either a right or left hand corner of the implement 12.

First and second spaced apart fluid operated lift jacks 40,42 are provided for elevationally moving the implement relative to the frame 14. The fluid operated lift jacks are preferably hydraulically operated fluid operated lift cylinders of well known construction. The first lift jack 42 has a first end portion 44 pivotally connected to the frame 14 and the second lift jack 42 has a first end portion 46 pivotally connected to the frame 14. The first lift jack 40 has a second end portion 48 which is pivotally connected to the implement 12 and the second lift jack 42 has a second end portion 50 which is pivotally connected to the implement 12. These pivotal connections to the frame 14 and the implement 12 are made in any suitable well known manner, for example such as by a pivot pin and clevis arrangement. The second end portions 48,50 are extensibly movable relative to the respective first end portions 44,46. Elevational movement of the implement 12 (about the pivotal connection of the first and second push arms 22,24) relative to the frame 14 is responsive to this extensible movement. The lift jacks 40,42 are spaced a preselected distance "D" (FIG. 3) at the pivotal connection of the second end portions 48,50 to the implement 12.

Figure 2:
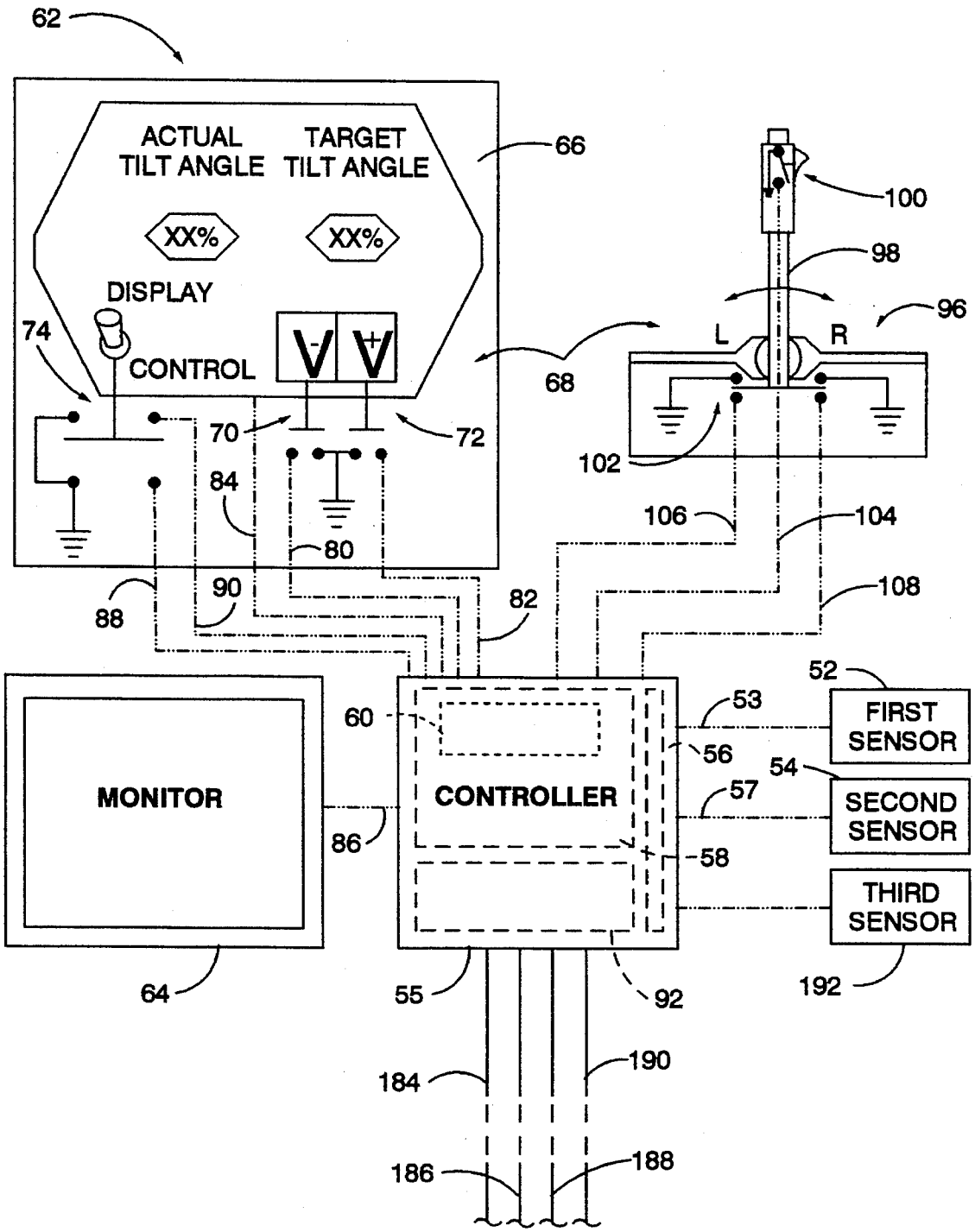
FIG. 2 is a diagrammatic schematic representation of an embodiment of the control system of the present invention.

Referring to FIG. 2, a first sensing means 52 is connected to the first lift jack 40. The first sensing means 52 is provided for sensing the position of the first lift jacks second end portion 48 relative to the first end portion 44 and delivering a responsive first position signal.

A second sensing means 54 is connected to the second lift jack 42. The second sensing means is provided for sensing the position of the second lift jacks second end portion 50 relative to the first end portion 46 and delivering a responsive second position signal.

The first and second sensing means 52,54 each preferably include a linear variable differential transformer (LVDT) of a type well known in the art. An LVDT is a magnetic position responsive device which generates a pulse width modulated (PWM) signal. In the particular application disclosed herein, the PWM signal generated by the first sensing means 52 is proportional to the relative positions of the first 44 and second 48 end portions of the first 40 lift jack, and the PWM signal generated by the second sensing means 54 is proportional to the relative positions of the first 46 and second 50 end portions of the second lift jack 42. It should be noted that other well known devices, for example, a yoyo type encoder, potentiometer, or resolver, and an RF signal generator are suitable replacements for the LVDT and within the scope of the invention.

The first and second sensing means 52,54 are connected to a control means 55 by lines 53 and 57, respectively. The control means 55 includes a converting means 56 having and integrator for converting a pulse width modulated signal to a voltage and a A/D converter for changing an analog signal to a representative digital signal. The delivered PWM signal is converted to a digital signal for the purpose of further processing.

The control means 55 includes a processor 58 of any appropriate type suitable for processing the first and second position signals in accordance with preprogrammed instructions and a memory 60 for storing instructions, information, and processed information. The control means 55 determines the magnitude of difference between the relative positions of the second end portion 48,50 of the first and second lift jacks 40,42, based on the first and second position signals, calculates a tilt angle value θ (the actual tilt angle value of the implement), and delivers a responsive implement tilt angle signal.

Figure 3:
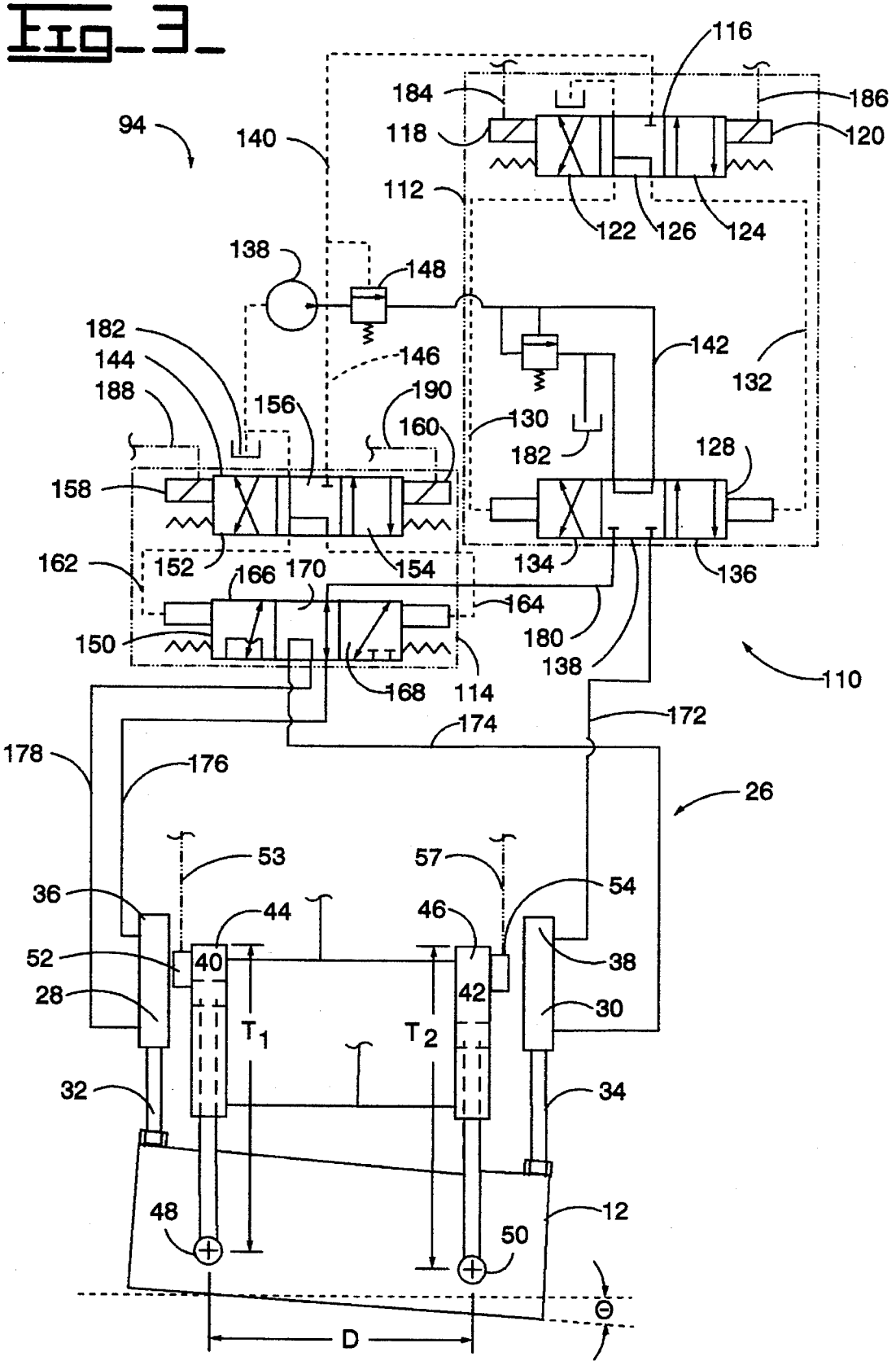
FIG. 3 is a diagrammatic schematic of a fluid operated system provided for positioning the implement.

The implement tilt angle θ is computed as follows:

$$\theta=\text{Arctan}(T_1-T_2)/D$$

where:

$T_1$=The magnitude of the distance between the first and second end portions 44,48 of the first lift jack 40 (FIG. 3).

$T_2$=The magnitude of the distance between the first and second end portions 46,50 of the second lift jack 42 (FIG. 3).

$D_1$=The distance between the second end portions 48,50 of the first and second lift jacks 40,42.

A display means 62, which is connected to the control means 55, receives the implement tilt angle signal and indicates a corresponding actual tilt angle of the implement relative to a predetermined baseline position 76. Since the system is dynamic the displayed corresponding tilt angle of the implement 12 relative to the predetermined baseline position 76 will change during tilting movement of the implement. The baseline 76 is established relative to the machine 10 or relative to another reference. The baseline preferably lies in a horizontal plane. However, positions other than in a horizontal plane may be selected without departing from the spirit of the invention.

As shown in FIG. 2, the display means 62 includes a monitor 64 and an indicator 66. It is to be noted that either the monitor 64 or indicator 66 may be eliminated without departing from the spirit of the invention. The monitor 64 may be color or monochromatic and of any suitable commercially available construction. The monitor 64 displays a pictorial representation of the tilted implement 12, determined by the aforementioned tilt angle calculations, relative to the baseline 76 and indicates the calculated tilt angle θ (actual tilt angle) of the implement 12 relative to the baseline 76. A target tilt line 78 showing the desired tilt angle α relative to the baseline 76 is also displayed. The baseline 76 and the target line 78 are represented respectively by different types of lines, hidden and phantom lines.

The indicator 66 numerically displays the actual tilt angle θ relative to the baseline 76 and a desired tilt angle α relative to the baseline 76. The indicator 66 may include a rotary or a radial dial indicator, a light emitting diode indicator, and a liquid crystal display or a combination thereof.

A command means 68, connected to control means 55, is controllably actuatable to deliver a selected one of a plurality of implement tilt command signals to the control means 55 in either analog or digital form. The command means 68, includes first and second button type selector switches 70,72. The direction of the desired tilt angle of the implement 12 is indicated by an illuminated one of commercially available left and right button type selector switches 70,72. The selector switches 70,72 enable the operator to select the magnitude of the desired tilt angle α and the direction of tilting of the implement 12. Selection is achieved by simply depressing one of the switch buttons 70,72 and maintaining the button depressed until the desired tilt angle α displayed on the indicator 66 indicates the desired tilt angle. The target line 78 on the monitor 64 will, during selection of the desired tilt angle α, indicate pictorially by an appropriate angled target line 78, the desired tilt angle α being numerically displayed on the indicator 66.

The left and right switches 70,72 are connected via lines 80 and 82 to the control means 55 and to ground. When depressed the switches connect the control means to ground and causes the control means 55 to deliver a signal via line 84 to the indicator 66 and line 86 to the monitor. Depending on which switch button is depressed and the current direction of tilting of the implement, the magnitude of the desired tilt angle α will increase or decrease and the direction of tilt from the baseline 76 will be illuminated on the appropriate one of the right or left selector switch buttons 70,72. The target tilt line 78 on the monitor 64 will reflect this angled position. The indicator 66 advances incrementally and displays the appropriate numerical value of the desired tilt angle α.

The command means 68 also includes a switch means 74, for example, a two position toggle switch, which is movable between a display position and a control position. In the control position line 88 is connected to ground and in the display position line 90 is connected to ground. In the control position the control means 55 is conditioned to deliver an implement tilt control signal to a fluid operated implement control system 92. In the display position the control means 55 is conditioned to deliver a signal to the display means 62 via lines 84 and 86 and display the actual tilt angle α, as determined by the above disclosed calculations, numerically on the indicator and pictorially on the monitor. It is to be noted that in both the display and control positions of switch means 74 the actual tilt angle α will be indicated in the manner described above.

At the control position of the switch means 74, the control means 55, based on preprogrammed instructions, automatically compares the desired tilt angle θ (shown as the target tilt angle on the indicator 66) stored in memory 60, the magnitude and direction of which was selected by way of the right and left selector switches 72,74, to the actual tilt angle α and delivers a responsive implement tilt control signal. The implement tilt control signal, based on this comparison, will command a driver circuit 92 of any suitable commercially available type to effect actuation of a fluid operated system 94 and thereby move the implement 12 in the proper direction to the desired implement tilt angle α. The control means 55, in response to the desired and corrected implement tilt angle positions being substantially the same, will stop delivering the implement tilt control signal and cause the driver circuit 92 to stop actuation of the fluid operated system 94. It is to be noted that in the context of this invention stopping delivery of the implement tilt control signal is equivalent to the act of delivering a stop control signal and positively effect cessation of actuation of the fluid operated system 94. Operation of the fluid operated system 94 will be subsequently discussed in greater detail.

The command means 68 includes a joystick controller 96 having a joystick 98 pivotally movable to a plurality of different positions. The joystick controller 96 is connected to the control means 55 and delivers a different tilt command signal at each of the different positions thereof. The joystick controller 96 is manually movable and includes a trigger switch 100 mounted on the joystick 98 for selecting first and second tilt modes of operation. In the second mode only one of the two tilt jacks 28,30 is actuatable between extended and retracted positions and in the first mode simultaneous operation of the two jacks 28,30, extension of one and retraction of the other is provided. A two position switch 102 is connected to the controller 96 and is responsive to pivotal movement of the joystick 98 for selecting the tilting direction movement, lower ("L") or raise ("R"), of one side of the implement 12, in the second mode of operation, or left ("L") or right ("R") tilting of the implement 12 in the first mode of operation. A potentiometer or other suitable variable signal generating device (not shown) delivers a different signal at each different position of the joystick 98 to control the speed of implement movement. The trigger switch 100 is connected to deliver a tilt second mode select signal to the control means 55 by line 104 when depressed, and the two position switch is connected to deliver a "L" and "R" tilt signal to the control means 55 by lines 106 and 108, respectively. It is to be noted that the joystick controller 96 also controls the lift and tip (pitch) of the implement 12 in a conventional manner and will therefore not be further discussed.

It should be noted that the joystick controller 96 may be used to set the desired tilt angle and thereby replace the left and right selector switches 70,72 previously discussed. To achieve this, the operator would simply use the joystick 98 to manually place the implement at the desired tilt angle position. By way of a set switch, manually actuated by the operator, a set signal would be delivered to the control means 55. The control means in response to this signal would learn the position, the calculated tilt angle and store this angle in memory 60 as the desired tilt angle.

The control means 55 responds to the tilt command signals delivered from the joystick controller 96 and delivers a responsive tilt control signal to the fluid operated system 94. The fluid operated system 94 responds to this signal and effects movement of the implement in a direction and at a speed selected by the joystick controller 96. It is to be noted that the actual tilt angle of the implement displayed by the display means 62 will change during manual operation by the joystick controller since the display is responsive to angle calculations based on the signals delivered from the first and second sensing means 52,54.

Referring to FIG. 3, the fluid operated control system 94 includes a valve means 110 for selectively directing pressurized fluid flow to said tilt jack means 26 and extending or retracting the rod end portion 32,34 of either or both of the first and second tilt jacks 28,30 in order to place the implement 12 at a desired tilted position. The valve means 110 includes, but is not limited to, first and second control valve means 112 and 114. The first control valve means 112 includes an electrohydraulic control valve 116 having first and second solenoid operated actuators 118,120 for shifting the control valve 116 between the first 122 and second 124 fluid directing positions from a spring biased neutral position 126. The first control valve means 112 includes a pilot operated control valve 128 connected to the electrohydraulic control valve 116 by conduits 130, 132 and shiftable between first 134 and second 136 positions from a spring biased neutral position 138 in response to pressurized fluid flow being delivered from valve 116 by conduits 130,132.

A pressurized fluid source such as a hydraulic pump 138 is connected to the electrohydraulic control valve 116 and the pilot operated control valve 128 via conduits 140, 142. The pressurized fluid source 138 is also connected to an electrohydraulic control valve 144 of second control valve means 114 by conduit 146. A pressure reducing valve 148 is provided to maintain the pilot pressure of the fluid delivered by conduits 140 and 146 at a predetermined value so that the pilot operated control valve 128 and a pilot operated selector valve 150 of the second control valve means 114 may be accurately controllably positioned by the respectively associated electrohydraulic control valves 116,144.

The electrohydraulic control valve 144 of the second control valve means 114 has first and second fluid directing positions 152,154 and a spring biased neutral position 156. First and second solenoids 158,160 are provided for shifting the valve 144 between the first and second fluid directing positions 152,154 from the neutral position 156. The second control valve means 112 includes a pilot operated selector valve 150 connected to the electrohydraulic control valve 144 by conduits 162, 164. The pilot operated selector valve 150 is shiftable between first 166 and second 168 positions, respectively, from a spring biased center position 170, in response to pressurized fluid flow being delivered from valve 144 by conduits 162 and 164, respectively. The head end portion 38 of the second tilt jack 30 is connected to a port of pilot operated control valve 128 via conduit 172 and the rod end portion 34 is connected to a port of the pilot operated selector valve 150 by conduit 174. The head end portion 36 of the first tilt jack 28 is connected to a port of the selector valve 150 by conduit 176 and the rod end portion 32 is connected to another port of the selector valve 150 by conduit 178. A port of each of the pilot operated selector and control valves 150, 128 are connected by conduit 180. The conduits mentioned above carry pressurized fluid flow between the tilt jack means 28 and the respective valves 128,150 in a conventional manner.

At the centered position 170 of the selector valve 150 the fluid operated system is conditioned to cause extension or retraction of one of the first and second jacks 40,42 and extension or retraction of the other of the first and second jacks opposite the one jack. The direction of extension and retraction is a function of the position of the pilot operated control valve 128. This results in rapid tilting movement of the blade in the right or left directions as viewed from the operators station 15. By way of illustration, at the first position 136 of the first control valve 128, fluid flow from the pump 138 is directed to the head end 38 of the second tilt jack 30 by conduits 142 and 172 to extend the rod end portion 34. Fluid flow from the rod end portion 34 of the second tilt jack 30 is delivered to the rod end 32 of the first tilt jack 28 via conduits 174,178 and the selector valve 150. And, fluid flow from the head end 36 is delivered to a reservoir 182 via conduits 176,180 and the selector and control valves 150,128. Shifting of the control valve 128 to the first position 134 will reverse the direction of fluid flow.

At the second position 168 of the selector valve 150 fluid flow is deliverable to either the rod or head end portion of the second tilt jack only and the first tilt jack 28 is hydraulically locked at the selector valve 150. This provides tilting of the blade in either the left or right directions as observed from the operators station 15 and as shown in FIGS. 3 and 4.

At the first position 166 of the selector valve 150 the rod end 34 of the second tilt jack 30 is connected to the head end 36 of the first tilt jack 28 which provides tipping of the implement in a direction as determined by the position of the control valve 128. Tipping movement of the implement 12 is pivotal movement of the implement in a forward or rearward direction about the pivot connection of the implement 12 to the lift arms 22,24.

Referring to FIG. 2, lines 184 and 186 connect the control means 55 to solenoids 118 and 120, respectively, and lines 188 and 190 connect the control means 55 to solenoids 158 and 160, respectively. The lines deliver implement tilt control signals to the respectively connected solenoids and shift the electrohydraulic control valves to a desired position determined by the controller based on the implement tilt command signal delivered from the command means 68. The implement tilt command signal, as previously indicated, is a function of the joystick controller 96 in the manual mode of operation or the left and right selector switches 70,72 and the switch means 74 in the automatic mode of operation. In the automatic mode (switch 74 being at the control position) the compared calculated tilt angle $\theta$ of the implement with the desired tilt angle $\alpha$ determines which of the solenoids 118,120 is to be actuated and shift the valve 116 to achieve the desired direction of tilting movement of the implement 12 and to position the implement 12 at the desired resultant implement angle $\alpha$. For example, should the actual implement angle $\theta$ be less than the desired tilt angle, a tilt control signal will be delivered to solenoid 120 which will shift the electrohydraulic control valve 116 to the second position 124. At this position the pilot fluid flow delivered by conduit 132 will shift pilot operated control valve 128 to the second position 136 which will deliver fluid flow via conduit 172 to extend the rod portion 34 until the implement 12 is at the desired tilt angle. When the desired tilt angle $\alpha$ and the calculated angle $\theta$ are substantially equal, within a preselected tolerance, the processor 58 will make this comparison based on feedback from the first and second sensors 52,54 and the angle calculated in response thereto, the control means 55 will cease delivering a signal to the solenoid 120. As a result valve 116 will, under the centering spring bias, return to position 126 and thereby cause the pilot operated control valve 128 to return to position 138. At this position movement of the second tilt jack will cease and the implement 12 will be maintained at the desired tilt angle $\alpha$. This comparison is made whenever the switch means 68 is at the control position, the automatic mode of operation.

It should be recognized that in the automatic mode of operation selector valve 150 is at the centered position 170. This however is only one of two possible options as presented. It should be recognized that the selector valve 150 may be at the second position 168 in the automatic control mode without departing from the spirit of the invention. An additional switch or the trigger switch 100 may provide selection between the two modes during the automatic control mode of operation.

As seen in FIG. 2, a third sensing means 192 may be provided for sensing the angle of the frame 14 relative to a horizontal plane and delivering a responsive frame angle signal to the control means 55 by line 194. The third sensing means 192 preferably includes an inclinometer of any well known commercially available type. The inclinometer is mounted on the machine frame 14 at a location on the frame in close proximity to the center of gravity of the machine 12. The inclinometer produces an analog signal which is converted to a digital signal for purposes of processing by the control means 55. The control means 55, and specifically the processor 58, combines the frame angle and the calculated tilt angle and delivers a responsive corrected tilt angle signal. The corrected tilt angle signal is delivered to the display means 62. Specifically, the corrected tilt angle signal is delivered by line 86 to the monitor 64 and displayed thereon. The corrected tilt angle, pictorially shown in FIG. 4, is represented by angle θ, the same as the actual tilt angle θ discussed above. A corrected tilt angle signal is also delivered to the indicator 66, and represented, as shown above as the actual tilt angle on the indicator.

It is to be noted that the third sensing means 192 includes the use of a differential kinematic global position system of a type well known in the industry. Such a system utilizes at least one receiver on the vehicle and a processor for calculating the angle of the machine frame 14 relative to a true vertical line. This information is then combined with the calculated tilt angle as indicated above to establish a corrected tilt angle.

In applications where the third sensing means 192 is provided automatic and manual control is achieved in substantially the same manner as previously discussed. The only difference is that the actual tilt angle value is replaced by the corrected tilt angle value. Since the tilt angle of the machine 10 relative to the horizontal plane is included in determining the corrected tilt angle, the tilted angle of the implement 12 relative to a horizontal plane is relatively accurate and provides the capability of producing a more accurate slope during machine movement.

INDUSTRIAL APPLICABILITY

With reference to the drawings, and in operation, the operator may manually control tilting of the implement by way of the joystick controller 96 as discussed above or automatically control the tilt angle of the implement to a desired tilt angle by placing switch means 74 in the control mode position.

In the manual mode of operation the operator may observe the actual tilt angle of the implement 12 relative to the target tilt angle by referring to the monitor 64 and/or the indicator 66. Since this is a more accurate way of determining the actual tilt angle of the implement 12 relative to the target tilt angle than visually observing the position of the actual implement, the speed at which the earth moving operation is performed may be increased and the number of passes may be reduced.

In the automatic (control) mode of operation the control system eliminates the guess work by the operator and automatically positions the implement 12 to the desired tilt position and maintains the implement 12 at the desired tilt position even under the dynamics of machine 10 operation. It is to be emphasized that the high degree of accuracy provided in determining the actual tilt angle by way of the above noted calculations based on the signals delivered by the first and second sensing means 52,54 provides a basis upon which control accuracy is achieved. In addition, the third sensing means 192 enables the tilt control system to compensate for the dynamics of operation of the machine and thereby maintain the tilt angle of the implement 12 at the desired tilt angle relative to a baseline based on a true horizontal plane.

Other aspects, objects and advantages of the present invention can be obtained from a study of the drawings, the disclosure, and the appended claims.

I claim:

1. A tilt angle control system for a geographic surface altering implement, comprising:

a frame;

first and second fluid operated lift jacks each having first and second end portions and each being connected at said first end portion to said frame and at said second end portion to said implement, said second end portion of the first and second lift jacks being spaced from each other a preselected distance at the implement connection, said second end portion of the first and second lift jacks being movable relative to the first end portion of the first and second lift jacks, respectively, and said implement being movable relative to the frame in response to movement of at least one of the lift jacks second end portion;

first sensing means for sensing the position of the second end portion of the first lift jack relative to the first end portion of the first lift jack and delivering a responsive first position signal;

second sensing means for sensing the position of the second end portion of the second lift jack relative to the first end portion of the second lift jack and delivering a responsive second position signal;

control means for receiving said first and second position signals, determining a magnitude of difference between the relative positions of the second end portion of the first and second lift jacks, calculating a tilt angle based on the relative difference, and delivering a calculated tilt angle signal.

2. A tilt angle control system, as set forth in claim 1, including display means for receiving said tilt angle signal and indicating a corresponding tilt angle of said implement relative to a predetermined baseline.

3. A tilt angle control system, as set forth in claim 2, wherein said display means pictorially displaying said implement at said corresponding tilt angle relative to the predetermined baseline.

4. A tilt angle control system, as set forth in claim 1, including:

command means for delivering a selected one of a plurality of implement tilt command signals;

said control means receiving said one implement tilt command signal and delivering a responsive implement tilt control signal;

valve means for receiving said implement tilt control signal and responsively delivering pressurized fluid flow; and tilt jack means for receiving said pressurized fluid flow and tilting said implement in response to receiving said pressurized fluid flow, said tilt jack means being connected to said implement.

5. A tilt angle control system, as set forth in claim 4, including display means for receiving said tilt angle signal and indicating a corresponding tilt angle of said implement relative to a predetermined baseline during tilting movement of said implement.

6. A tilt angle control system as set forth in claim 4, wherein said tilt jack means includes first and second spaced apart extensible tilt jacks connected to and between said frame and implement, said valve means being connected to said first and second tilt jacks and being movable between a first position at which fluid flow is delivered from said valve means to said first tilt jack to extend said first tilt jack and tilt said implement in a first direction, and a second position at which fluid flow is delivered by said valve means to said second tilt jack to extend said second tilt jack and tilt said implement in a second direction, said valve means being movable to one of the first and second positions in response to receiving said one implement tilt control signal.

7. A tilt angle control system, as set forth in claim 4, wherein said selected one implement tilt command signal defines a desired implement tilt angle, said control means comparing the desired implement tilt angle to the calculated tilt angle and stopping the delivery of said implement tilt control signal in response to said calculated and desired implement tilt angles being substantially equal, said valve means stopping delivery of pressurized fluid flow to said tilt jack means in response to said calculated and desired implement angles being substantially equal.

8. A tilt angle control system, as set forth in claim 5, wherein said tilt jack means includes first and second spaced apart tilt jacks, said command means includes a joystick controller having a joystick pivotally movable to a plurality of different positions, said command means delivering a different implement tilt command signal at each of said different positions of said joystick, said valve means controlling the relative speed and direction of movement of the first and second tilt jacks as a function of the position of the joystick.

9. A tilt angle control system, as set forth in claim 1, wherein said first and second signals delivered by said first and second sensing means being a function of the magnitude of the distance between the first and second end portions of the first and second lift jacks, respectively.

10. A tilt angle control system, as set forth in claim 9, wherein the control means calculates the tilt angle of the implement in accordance with the following equation:

$$\theta=\text{Arctan}(T_1-T_2)/D$$

where:

$\theta$=The tilt angle;

$T_1$=The magnitude of the distance between the first and second end portions of the first lift jack;

$T_2$=The magnitude of the distance between the first and second end portions of the second lift jack; and $D_1$=The distance between the second end portions of the first and second lift jacks.

11. A tilt angle control system, as set forth in claim 7, wherein said implement tilt command signal being one of an analog or digital signal.

12. A tilt angle control system, as set forth in claim 3, wherein said predetermined baseline is a horizontal line.

13. A tilt angle control system, as set forth in claim 1, wherein said first and second sensing means each include a linear variable differential transformer connected to a respective one of said first and second lift jacks.

14. A tilt angle control system, as set forth in claim 1, including a third sensing means for sensing an angle of the frame relative to the horizontal and delivering a responsive frame angle signal, said control means combining the frame angle and the tilt angle and delivering a responsive corrected tilt angle signal.

15. A tilt angle control system, as set forth in claim 14, including display means for receiving said corrected tilt angle signal and indicating a corrected tilt angle of said implement relative to a predetermined baseline.

16. A tilt angle control system, as set forth in claim 1, including:

selector means for selecting a desired implement tilt angle relative to a predetermined baseline;

switch means for selecting one of a display and control mode of operation, said control means comparing said calculated tilt angle to a predetermined desired tilt angle in response to said switch means selecting said control mode of operation and delivering an implement tilt control signal in response to said desired and calculated tilt angle values being at a different magnitude;

valve means for receiving said implement tilt control signal and responsively delivering pressurized fluid flow;

tilt jack means for receiving said pressurized fluid flow and tilting said implement in response to receiving said pressurized fluid flow, said tilt jack means being connected to said implement.

17. A tilt angle control system for a geographic surface altering implement, comprising:

a frame;

first and second fluid operated lift jacks each having first and second end portions and each being connected at said first end portion to said frame and at said second end portion to said implement, said second end portion of the first and second lift jacks being spaced from each other a preselected distance at the implement connection, said second end portion of the first and second lift jacks being movable relative to the first end portion of the first and second lift jacks, respectively, and said implement being movable relative to the frame in response to movement of at least one of the lift jacks second end portion;

first sensing means for sensing the position of the second end portion of the first lift jack relative to the first end portion of the first lift jack and delivering a responsive first position signal;

second sensing means for sensing the position of the second end portion of the second lift jack relative to the first end portion of the second lift jack and delivering a responsive second position signal;

third sensing means for sensing an angle of the frame relative to the horizontal and delivering a responsive frame angle signal;

control means for receiving said frame angle signal, said first position signal, and second position signal, determining a magnitude of difference between the relative positions of the second end portion of the first and second lift jacks based on said first and second position signals, calculating a tilt angle based on the magnitude of difference and the preselected distance at the implement connection, combining the frame angle and the tilt angle and delivering a responsive corrected tilt angle signal representative of a corrected implement tilt angle.

18. A tilt angle control system, as set forth in claim 17, including display means for receiving said corrected tilt angle signal and indicating a corrected tilt angle of said implement relative to a predetermined baseline.

19. A tilt angle control system, as set forth in claim 18, wherein said predetermined baseline represents a horizontal plane.

20. A tilt angle control system, as set forth in claim 17, including:

command means for delivering a selected one of a plurality of implement tilt command signals;

said control means receiving said selected one implement tilt command signal and delivering a responsive implement tilt control signal;

valve means for receiving said implement tilt control signal and responsively delivering pressurized fluid flow; and tilt jack means for receiving said pressurized fluid flow and tilting said implement in response to receiving said pressurized fluid flow, said tilt jack means being connected to said implement.

21. A tilt angle control system, as set forth in claim 20, including display means for receiving said tilt angle signal and indicating a corresponding tilt angle of said implement relative to a predetermined baseline during tilting movement of said implement.

22. A tilt angle control system, as set forth in claim 20, wherein said selected one implement tilt command signal defines a desired implement tilt angle, said control means comparing the desired implement tilt angle to the corrected implement tilt angle and stopping the delivery of said implement tilt control signal in response to the desired and corrected implement tilt angles being substantially the same, said valve means preventing the delivery of pressurized fluid flow to said tilt jack means in response to said desired and corrected implement tilt angles being substantially equal.

23. A tilt angle control system, as set forth in claim 20, wherein said tilt jack means includes first and second spaced apart tilt jacks, said command means includes a joystick pivotally movable to a plurality of different positions, said command means being connected to said control means and being adapted to deliver the selected one of the plurality of different tilt command signals at a selected one of the plurality of joystick positions, said valve means receiving said selected one tilt command signal and controlling the relative speed and direction of movement of the first and second tilt jacks as a function of the selected position of joystick.

24. A tilt angle control system, as set forth in claim 17, wherein said first and second sensing means each include a linear variable differential transformer connected to a respective one of said first and second lift jacks.

25. A tilt angle control system, as set forth in claim 17, wherein said third sensing means includes an inclinometer mounted on said frame and connected to said control means.

26. A tilt angle control system, as set forth in claim 20, wherein said command means including a joystick control pivotally moveable to one of a plurality of positions, said joystick control delivering said one of a plurality of tilt command signals at said one position.

27. A tilt angle control system, as set forth in claim 17, including:

means for selecting a desired implement tilt angle relative to a predetermined baseline;

switch means for selecting one of a display and control mode of operation and delivering a responsive signal, said control means receiving said one signal comparing said corrected tilt angle to a predetermined desired tilt angle in response to said switch means selecting said control mode of operation and delivering an implement tilt control signal in response to said desired and corrected tilt angles being at a different magnitude;

valve means for receiving said implement tilt control signal and responsively delivering pressurized fluid flow;

tilt jack means for receiving said pressurized fluid flow and tilting said implement in response to receiving said pressurized fluid flow, said tilt jack means being connected to said implement.

* * * * *